US005196655A

United States Patent [19]

Woods

[11] Patent Number: 5,196,655

[45] Date of Patent: Mar. 23, 1993

[54] MUFFLER FOR MARINE ENGINE

[76] Inventor: Woodrow E. Woods, 3640 Fiscal Ct., Riviera Beach, Fla. 33404

[21] Appl. No.: 786,101

[22] Filed: Oct. 31, 1991

[51] Int. Cl.[5] ..... F01N 7/12

[52] U.S. Cl. ..... 181/235; 181/264; 181/272; 440/89

[58] Field of Search ..... 181/235, 264, 265, 272, 181/269; 440/89

[56] References Cited

U.S. PATENT DOCUMENTS

| | | | |
|---|---|---|---|
| 2,241,010 | 5/1941 | Chipley | 181/272 |
| 4,002,136 | 1/1977 | Michalak | 181/235 |
| 4,192,404 | 3/1980 | Nakagana et al. | 181/272 |
| 4,305,477 | 12/1981 | Moore | 181/272 |
| 4,744,778 | 5/1988 | Porter | 181/235 |
| 4,786,265 | 11/1988 | Porter | 181/235 |

FOREIGN PATENT DOCUMENTS

| | | | |
|---|---|---|---|
| 0464481 | 6/1975 | U.S.S.R. | 440/89 |

*Primary Examiner*—Michael L. Gellner
*Assistant Examiner*—Eddie C. Lee
*Attorney, Agent, or Firm*—Malin, Haley, DiMaggio & Crosby

[57] ABSTRACT

An improved muffler for silencing the exhaust emitted from a water cooled marine engine comprising a housing enclosure partitioned by an angularly disposed inner planar baffle, the housing having an inlet for the exhaust gas and cooling water to fluidly communicate with a lower silencing chamber wherein the exhaust gas and cooling water are forced through a central passageway into an upper silencing chamber resulting in flow reversal and diminution in flow velocity so as to attenuate the exhaust noise, the exhaust gas and cooling water exiting the upper silencing chamber through an outlet fluidly communicated therewith and disposed collinearly with the input. The upper silencing chamber acting as a back flow preventor.

11 Claims, 4 Drawing Sheets

MUFFLER FOR MARINE ENGINE

BACKGROUND OF THE INVENTION 1. of the Invention

This invention relates generally to a muffler for quieting the exhaust from an internal combustion marine engine, and, more particularly, to an improved lift muffler which permits the exhaust outlet therefrom to be placed at a lower level relative to the exhaust inlet to widen the range of positions and applications in which a lift muffler may be used, and to provide a lift muffler having a reverse flow surge protector.

2. Description of the Prior Art

The exhaust of the typical marine vessel is directed through either the drive system in an inboard/outboard unit or simply through the transom in a inboard drive setup. Both applications place the exhaust outlet near or below the water line leading to possible back flow situations when the exhaust gas does not present enough force to overcome a water surge, or where water enters the exhaust pipe while the engine is off. To prevent this back flow of water into the muffler or engine, a check valve or flapper valve is usually employed. However, flapper valves, having moving parts, quickly corrode and fail, leading to a potentially dangerous blockage of exhaust flow.

There are a variety of marine mufflers presently known in the art which are of the "axial flow" type such as the muffler disclosed in U.S. Pat. No. 4,167,987, issued to Turner. The Turner patent describes a multiple flow marine muffler wherein exhaust noise is attenuated by passing the exhaust gas through a series of longitudinally spaced opposing baffles. Although the device allows an in-line connection, such a configuration requires an elongated cylindrical shell to provide the required baffling effect, thus precluding application in tight-fit areas such as smaller boats or other situations where space is at a premium. The use of an axial flow muffler does not address the need to counter water surges. Also, axial flow mufflers cannot be placed below the water line without some form of surge suppression.

Another marine muffler, known as a "lift muffler," is disclosed in U.S. Pat. No. 3,296,997, issued to Hoiby, et al. The Hoiby muffler is essentially an up-right drum-shaped housing having an exhaust inlet near the top and a stand pipe exhaust outlet centrally located with its opening spaced above the drum bottom. The stand pipe directs the muffled exhaust gas and collected cooling water upwardly and outwardly to a location where it can be discharged from the boat without further back pressure. Such a device precludes application in tight-fit areas as the centrally located stand pipe requires exhaust conduit modifications to accommodate the pipe. Further, Hoiby does not present a means to prevent a reverse flow of water when the exhaust outlet is submerged.

Another type of marine muffler is disclosed in U.S. Pat. No. 4,917,640, issued to Miles. Miles teaches the use of a marine muffler wherein the engine exhaust is displaced between chambers through a series of parallel conduits transverse to the muffler body length. Cooling water from the exhaust manifold is condenses at the bottom of the main chamber, a portion thereof remaining in the chamber, the remainder of which evaporates or is otherwise evacuated by exhaust gas out of the muffler body. The exhaust noise is attenuated by baffling the exhaust gas through multiple chambers and in contacting the entrapped water. However, this type of muffler is not amenable to mounting within the boat hull without elaborate piping geometry so that the muffler can be fed at the top and evacuated at the bottom.

Muffler outlet placement close to, or beneath, the water line requires a means for preventing the back flow of water. Conventional lift mufflers employ only a horizontal baffle subject to back flow.

Therefore, there exists a need for a muffler capable of installation within a boat hull wherein the exhaust inlet and outlet may be situated at the same level to permit in-line placement, thus providing the benefits of an in-line lift muffler having surge suppression characteristics.

SUMMARY OF THE INVENTION

The present invention provides an improved lift muffler for use with internal combustion marine engines. The muffler comprises a housing having a curved side wall joined by a top and bottom end which collectively define an internal chamber therein. An impervious planar baffle is angularly disposed within this chamber and is sealably attached to the housing side wall thereby partitioning the chamber into a lower and an upper silencing volume. The planar baffle defines a centrally disposed aperture therethrough which receives a vertical elongated passageway therein which is sealingly attached to the baffle, is of an overall length less than the distance between the top and bottom end walls of the housing, and fluidly communicates the upper and lower silencing volumes. An exhaust inlet passageway for carrying exhaust gases and cooling water from the exhaust manifold into the lower silencing volume extends outward from the side wall a distance above the housing bottom end. Mounted opposite thereto, preferably at the same vertical location, is an outlet passageway for evacuating exhaust gas and cooling water from the upper silencing volume.

The muffler functions by redirecting the exhaust gas flow, and in turn reducing the velocity of the exhaust gas which consequently reduces the acoustic energy of the exhaust emission. Exhaust gas is directed to the inlet of the device and into the lower silencing volume. Condensed cooling water, which originally had been mixed with exhaust gas flowing from the engine to cool the exhaust gas, accumulates at the bottom of the lower silencing volume which aids baffling or dampening of the exhaust flow energy as well as reducing the operating temperature within the device. The elevated pressure within the lower silencing volume forces the gas and vaporized water upward through the vertical passageway and into the lower pressure upper silencing volume where the direction of exhaust gas flow is altered by the angularly disposed planar baffle, side walls and top wall before exiting through the outlet passageway. The planar baffle functions as a sound absorbing acoustical barrier, as an inner wall for guiding the exhaust gas and cooling water to the outlet passageway, and as a surge suppressor or protector for preventing the reverse flow of water into the engine by creating a ramp angled toward the outlet passageway In accordance with the present invention, it is an object to provide an improved muffler for use with marine engines which permits installation within a minimal space in a boat hull.

It is an additional object of the instant invention to provide an improved lift muffler which allows placement of the inlet and outlet exhaust passageways at similar vertical positions relative to one another, thus allowing lower placement of the exhaust outlet relative to the water line without additional piping or effecting back pressure characteristics of the muffler.

It is still another object of the instant invention to provide an angularly disposed baffle for directing water from within the upper volume of a lift muffler toward the exhaust gas outlet.

It is yet still another object of the instant invention to provide a device having the benefits of a stand pipe break in the exhaust flow path, similar to an in-line muffler, including a second break effectively operating as a surge protector.

In accordance with these and other objects which will become apparent hereinafter, the instant invention will now be described with particular reference to the accompanying drawings.

DETAILED DESCRIPTION OF THE PREFERRED EMBODIMENT

Figure 1:
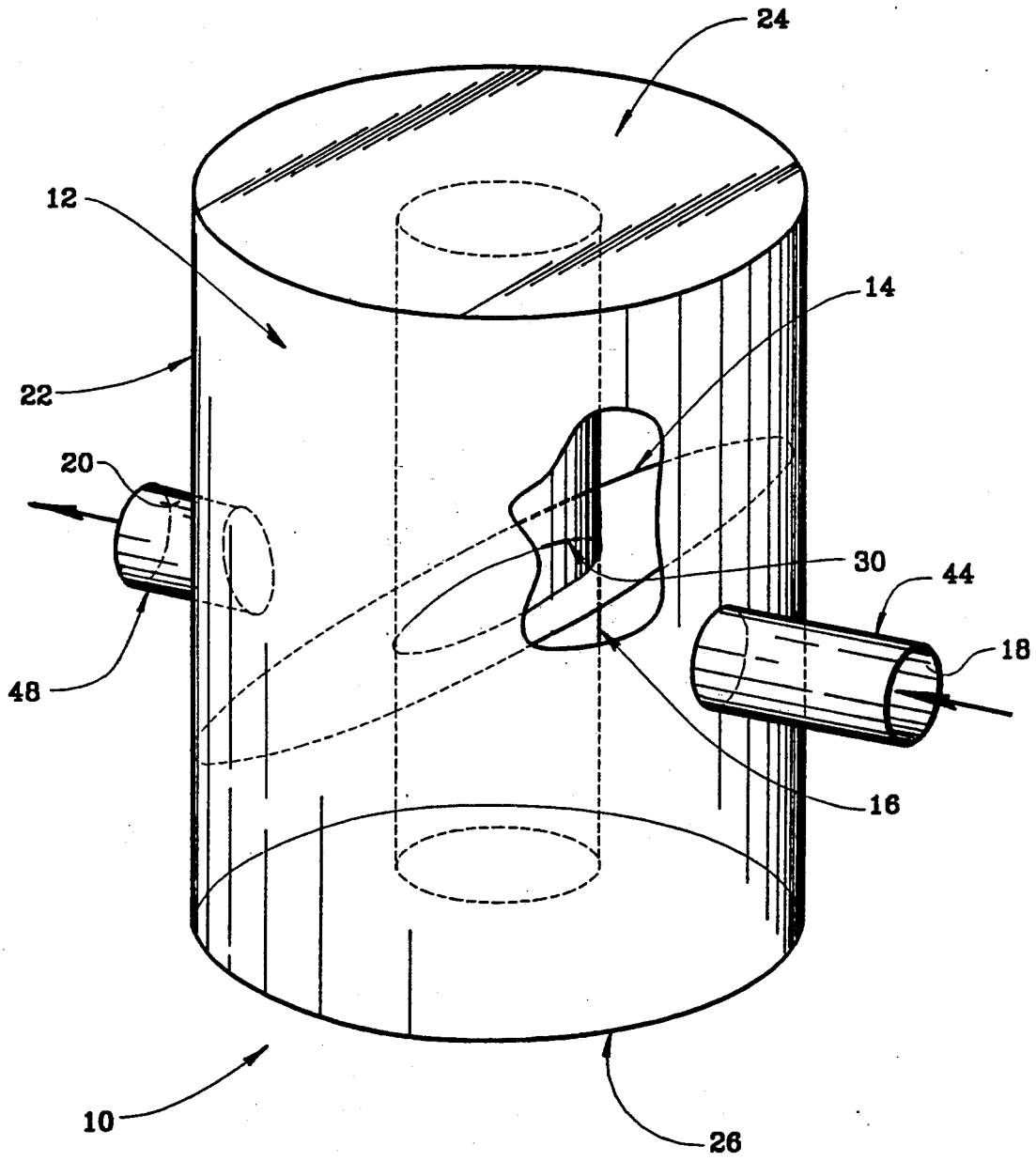
FIG. 1 is an isometric view of the muffler assembly of the instant invention.

With reference to the several views of the drawings, there is depicted an improved lift muffler apparatus generally characterized by the reference numeral 10 which comprises a housing enclosure 12, a planar baffle 14, a central passageway 16, and inlet and outlet passageways 18 and 20 respectively.

Figure 2:
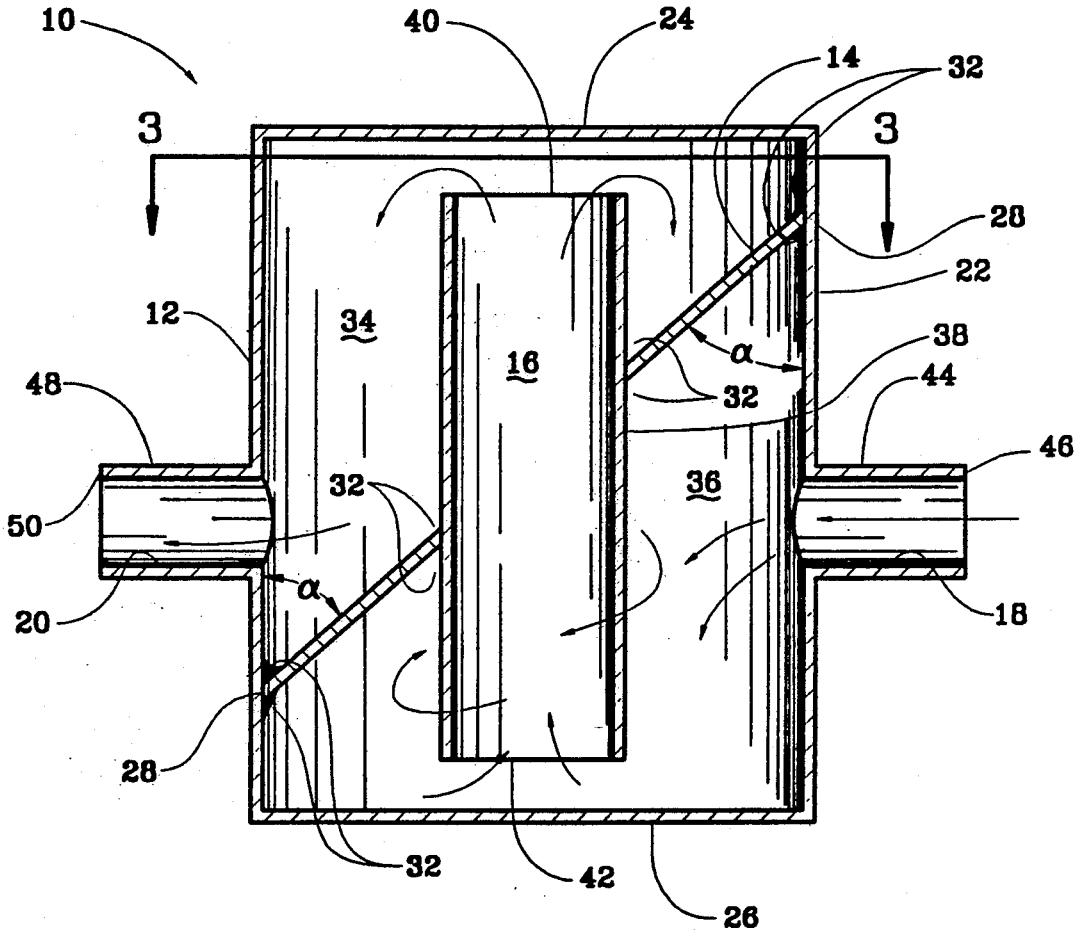
FIG. 2 is a section view of the muffler assembly taken along lines 2—2 of FIG. 3.
Figure 3:
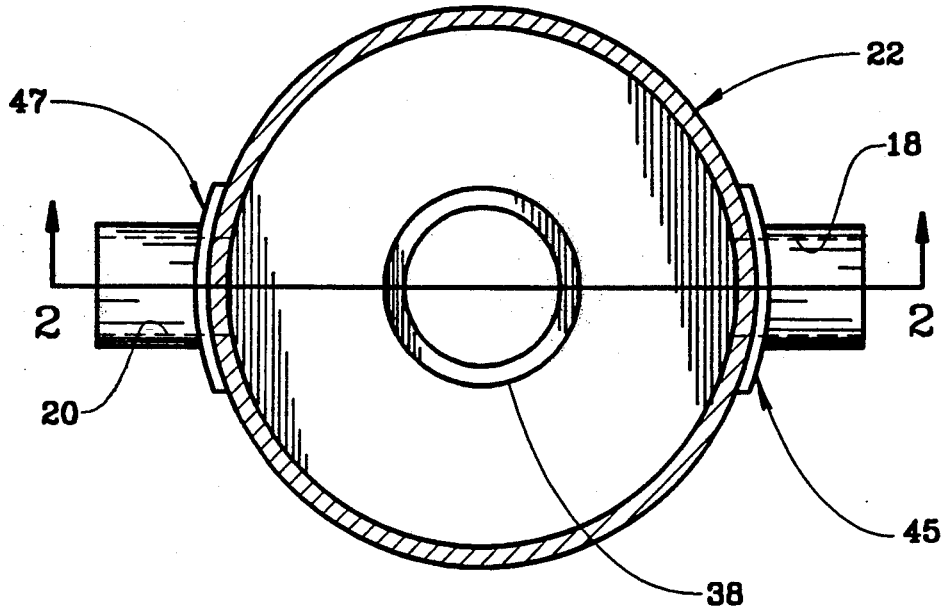
FIG. 3 is a plan view of the preferred embodiment of the muffler assembly.

In the preferred embodiment shown in FIGS. 1, 2, and 3, housing 12 is a substantially cylindrical enclosure defined by curved side wall 22, and top and bottom ends 24 and 26 respectively. In order to facilitate assembly, housing 12 may be fabricated with either or both ends 24 and 26, being separate components which are sealably attached to side wall 22. The profile of wall 22 is cylindrical as best seen in FIG. 3. However, side wall 22 may be designed with a profile such as the shape shown in FIG. 4 to accommodate space constraints within the boat hull depending on the particular application. Housing 12 may be fabricated from, for example but not by way of limitation, fire retardant fiberglass reinforced plastic or from corrosion resistant metal such as stainless steel.

Baffle 14 is an impervious planar member having an outer peripheral edge 28 which is adapted to be rigidly connected within the confines of housing 12 at an angle $\alpha$ relative thereto as best seen in FIG. 2. Accordingly, outer peripheral edge 28 is elliptical when viewed normal to the planar surface of baffle 14. Baffle 14 defines an aperture 30 extending therethrouqh. Aperture 30 is sized to permit the insertion therein of central passageway conduit 16 which will be described in greater detail hereinafter. Baffle 14 is rigidly secured to and sealed against side wall 22 at outer peripheral edge 28. Baffle 14 is sealed against the interior of side wall 22 by any suitable means, such as welding 32, bonding or through use of an 0-ring (not shown), etc., so that baffle 14 partitions housing 12 into separate air tight chambers characterized as upper and lower silencing volumes 34 and 36 respectively.

Central passageway conduit 16 is an elongated cylindrical member having a bore therethrough for communicating, and allowing the escape of, exhaust gas and cooling water from within lower silencing volume 36 to upper silencing volume 34. Central passageway 16 is defined by a cylindrical wall portion 38, having an open top end 40 and an open bottom end 42. The external periphery of cylindrical wall portion 38 is rigidly and sealingly secured to baffle 14 by means of attachment such as bonding, welding or the like. Sealant 32 or weldment is added at the interface of wall 38 and baffle 14 to prevent leakage therebetween such that the only means of exhaust gas flow between upper and lower silencing volumes 34 and 36 is through central passageway 16. It is important to note that the central passageway 16 may be constructed having a section profile other than cylindrical and still fall within the scope of the invention.

As a means for carrying the influx of exhaust gases and cooling water into lower silencing volume 36, hollow tubular passageway 18 is provided which is defined by a cylindrical conduit portion 44 which is sealingly associated with housing side wall 22 at one end, and terminates in an outer edge 46 at the other end for attachment to the engine exhaust manifold pipe. A means for evacuating the exhaust gases and cooling water from upper silencing volume 34 is embodied in hollow tubular passageway 20 which is defined by a cylindrical conduit portion 48 which is sealingly associated with housing side wall 22 at one end, and terminates in an outer edge 50 at the other end for attachment to an exhaust passageway for transporting the exhaust gas and cooling water to the boat hull exterior. Inlet and outlet passageways 18 and 20, respectively, may be fabricated from fiberglass and/or molded integrally with housing 12. In the alternative, passageways 18 and 20 may be fabricated from metal and attached to housing 12 by, for example, bonding, welding or fastening end flanges 45 and 47, respectively, associated therewith, as shown in FIG. 3.

Muffler 10 silences the exhaust gas from the internal combustion marine engine by directing high velocity exhaust gas, and cooling water injected and mixed therewith, through inlet passageway 18 into lower silencing volume 36. As the exhaust gas and cooling water mixture enters lower silencing volume 36, a portion of the cooling water condenses and will accumulate to a level L along the bottom end 26 of housing 12 which aids in heat transfer and noise dissipation. The energy of the escaping exhaust gas through central passageway 16 will force the remaining differential volume of cooling water to vaporize or removed by convective and be transported mass transfer upwards through conduit 16 and into silencing volume 34 where the gas and water may escape through outlet passageway 20. The angularly disposed planar baffle 14 functions as an acoustical barrier by creating sonic reflections with the housing wall 22 which assist in dissipating the acoustical energy of the exhaust, and as a surge protector by protecting the reverse flow of water into the engine exhaust manifold by functioning as a ramp within upper silencing volume 34. The angular orientation of baffle 14 relative to housing side wall 22 additionally permits the lower placement of outlet passageway 20 relative to inlet passageway 18, so as to obviate the need for extraneous plumbing downstream of muffler 10, necessary in configurations where it is desired to place the exhaust pipe at a low level. Accordingly, less external exhaust piping is required, resulting in lower overall exhaust system back pressure and, thus, higher engine efficiency.

In accordance with the instant invention, upper silencing volume 34 acts as a reverse water surge protector by providing an inner volume having top end 40 of conduit 38 separate from outlet 20. Further, end 42 of conduit 38 is separate from inlet 18 providing a second break thereby preventing excess back pressure if 13 the outlet passageway 20 is temporarily filled with water.

Figure 4:
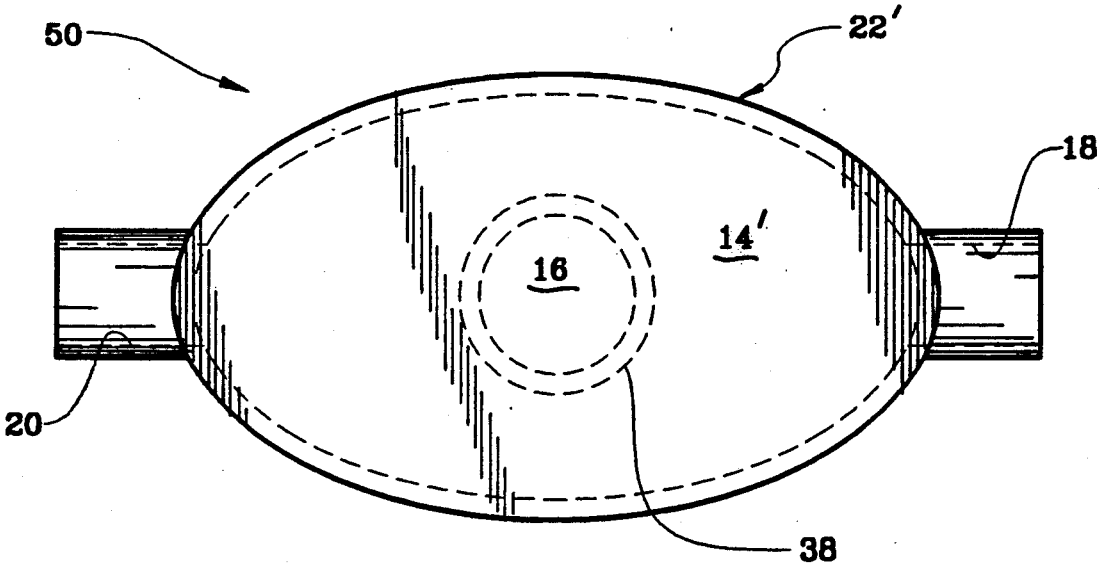
FIG. 4 is a plan view of the muffler assembly showing an alternative, elongated, housing embodiment.

FIG. 4 illustrates a second embodiment 50 of my lift muffler wherein housing wall 22' defines an elliptical section allowing the internal volume of the cylindrical housing to have a smaller width for space consideration. Baffle 14' is angularly disposed as set forth for baffle 14 in FIGS. 1-3 and defines a circular or other shaped cutout centrally thereof adapted to receive central passageway conduit 38. Muffler 50 operates as set forth for muffler 10.

Figure 5:
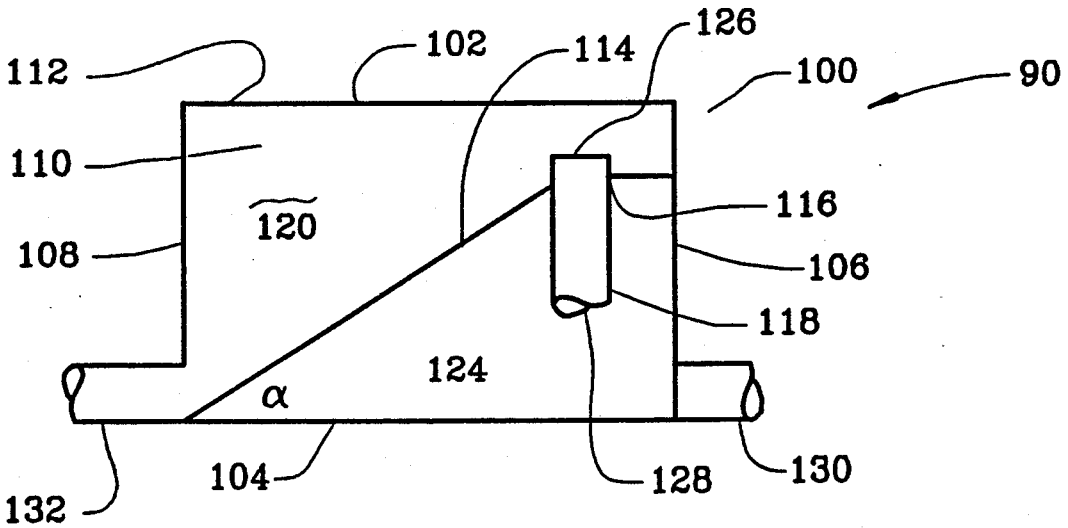
FIG. 5 is a cross-sectional elevational view of the muffler assembly in an alternative, rectangular, embodiment having the inlet and outlet in a lower plane.

FIG. 5 illustrates a third embodiment of my invention and includes a lift muffler having an elongated housing 100 defined by, for a polygonal shaped housing, top wall 102, bottom wall 104, inlet end wall 106, outlet end wall 108, side wall 110, and opposite side wall 112 (not shown). The profile can, alternatively, be cylindrical as described above.

Baffle 114 is a impervious planar member adapted to be rigidly installed within the confines of side walls 110, 112 at an angle $\alpha$ relative thereto between 30° and 50°. Accordingly, baffle 114 is rectangular when viewed normal to the baffle's planar surface or elliptical if the housing is made cylindrical. Upper segment 115 of baffle 114 may be substantially parallel to top wall 102, or may be parallel with segment 114, defining an aperture 116 to permit the insertion therein of central passageway conduit 118. Baffle 114 is rigidly and sealingly secured to side walls 110, 112 at its outer peripheral edge by means of attachment such as welding, bonding, or the like, to partition the housing into separate chambers characterized as upper and lower silencing volumes 120 and 12 respectively.

Central passageway conduit 118 is a hollow elongated cylindrical member for passing exhaust gas and cooling water from within lower silencing volume 124 to upper silencing volume 120. Central passageway conduit 118 has an open top end 126 and an open bottom end 128 and fluidly communicates volume 120 with volume 124. The external periphery of central passage way 118 is rigidly secured to baffle 114 by means of sealing attachment such as bonding or welding to prevent leakage therebetween. It is important to note that the central passageway 118 may be constructed having a cross-sectional profile other than cylindrical and still remain within the scope of the invention.

Hollow tubular passageway 130 is operatively associated with housing end wall 106 for attachment to the engine exhaust manifold. A means for evacuating the exhaust gases and cooling water from upper silencing volume 120 is embodied in hollow tubular passageway 132 operatively associated with housing end wall 108 for attachment to an exhaust passageway for transporting the exhaust gas and cooling water to the boat hull exterior.

As with the preferred embodiment, the muffler housing 110 silences the exhaust gas from the internal combustion marine engine by directing high velocity exhaust gas, and cooling water injected and mixed therewith, through inlet passageway 130 into lower silencing volume 124. The energy of the escaping exhaust gas will force the remaining differential volume of cooling water and gas upwards and into silencing volume 120 where the gas and water may escape through outlet passageway 132. The angularly disposed planar baffle 114 functions as an acoustical barrier by creating sonic reflections with the housing wall 110 which assist in dissipating the acoustical energy of the exhaust, and as a surge protector by the reverse flow of water into the engine exhaust manifold by acting as a ramp surface within upper silencing volume 120 to redirect any reverse flow of water entering volume 120 through exit conduit 132 back out of volume 120 through conduit 13 via gravity. Therefore, as with baffles 14, 14', baffle 114 should be disposed at an angle relative to the horizontal to direct water downwardly into conduit 132 so that gravity will draw any unwanted surge water out of volume 120. The instant design, having the inlet 130 and outlet 132 along the lower wall 104, effectively provides a larger volume relative to the condensation area provided in the lower volume 124. Accordingly, less external exhaust piping is required as in the preferred embodiment while further providing a larger workable upper silencing volume for handling water surges.

Figure 6:
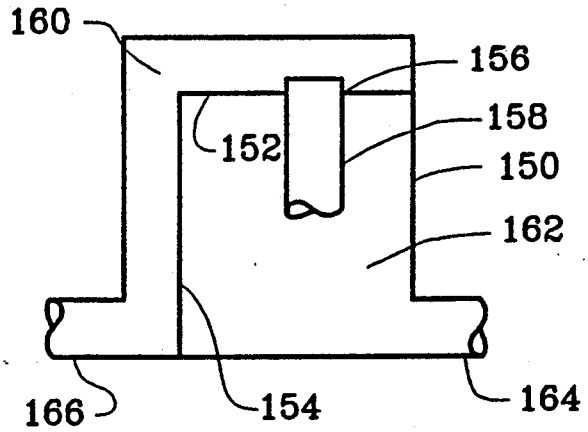
FIG. 6 is a cross-sectional elevational view of the muffler assembly in an alternative embodiment having a vertical surge protector.

FIG. 6 illustrates a fourth embodiment having a housing 150 made rectangular or cylindrical as previously described. In this embodiment, the baffle 152/154 creates a right angle by the use of horizontal baffle segment 152 and vertical baffle segment 154, each said wall being an impervious member sealingly installed within the confines of said housing. Horizontal baffle 152/154 defines an aperture 156 to permit the insertion therein of central passageway conduit 158. The baffle 152/154 partitions the housing into separate chambers characterized as upper and lower silencing volumes 160 and 162 respectively. In this fourth embodiment, baffle 154 forms angle of approximately 90° with the horizon, consequently $\alpha=90°$. Central passageway conduit 158 has a bore therethrough for passing exhaust gas and cooling water from within lower silencing volume 162 to upper silencing volume 160. Hollow tubular conduit 164 is adapted to be attached to the engine exhaust manifold. A means for evacuating the exhaust gases and cooling water from upper silencing volume 160 is embodied in hollow tubular conduit 166 sealingly associated with housing 150 for attachment to an exhaust passageway for transporting the exhaust gas and cooling water to the boat hull exterior.

As with the preferred embodiment the muffler housing 150 silences the exhaust gas from the internal combustion marine engine by directing high velocity exhaust gas and cooling water injected and mixed therewith, through inlet passageway 164 into lower silencing volume 162. The energy of the escaping exhaust gas will force the remaining differential volume of cooling water and gas upwards and into silencing volume 160 where the gas and water may escape through outlet passageway 166. The vertical baffle wall 154 acts as a surge protector by counteracting the reverse flow of water into the engine exhaust manifold by acting as a barrier to incoming surge water within upper silencing volume 160.

Figure 7:
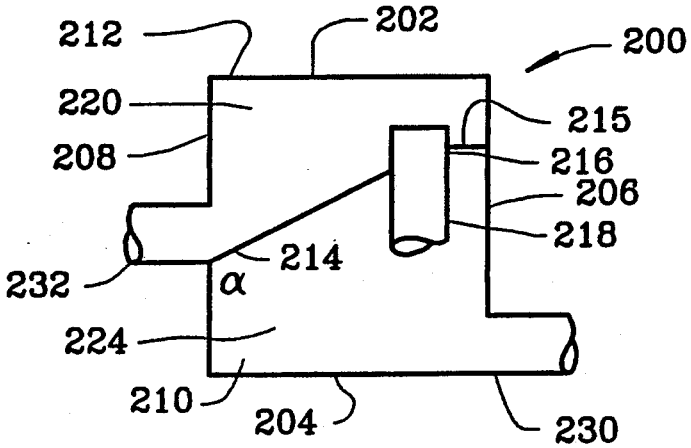
FIG. 7 is a cross-sectional elevational view of the muffler assembly in an alternative embodiment having the inlet and outlet placed on different planes.

FIG. 7 illustrates a fifth embodiment of my lift muffler having an elongated rectangular housing 200 defined by top wall 202, bottom wall 204, inlet end wall 206, outlet end wall 208, side wall 210, and opposite side wall 212, not shown. The profile can be cylindrical as described above.

Baffle 214 is an impervious planar member adapted to be rigidly installed within the confines of housing 200 at an angle $\alpha$ relative thereto between 30° and 50°. Accordingly, baffle 24 is rectangular when viewed normal to its planar surface or elliptical if the housing is made cylindrical. Upper portion 215 of baffle 214 is substantially parallel to top wall 202, or may be parallel to segment 214, detining an aperture 216 to permit the insertion therein of central passageway conduit 218. Baffle 214 is rigidly and sealingly secured to side wall 210, 212 at its outer peripheral edge by means of attachment such as welding, bonding, or the like, to partition the housing into separate chambers characterized as upper and lower silencing volumes 220 and 224 respectively.

Central passageway conduit 218 is an elongated cylindrical member having a bore therethrough for passing exhaust gas and cooling water from within lower silencing volume 224, to upper silencing volume 220. The external periphery of central passage way conduit 218 is rigidly secured to baffle 214 by means of attachment such as bonding or welding to prevent leakage therebetween. It is important to note that the central passageway conduit 218 may be constructed having profiles other than cylindrical within the scope of the invention.

Hollow tubular passageway 230 is operatively associated with housing end wall 206 for attachment to the engine exhaust manifold. A means for evacuating the exhaust gases and cooling water from upper silencing volume 220 is embodied in hollow tubular passageway 232 which is sealingly associated with housing end wall 208 for attachment to exhaust conduit (not shown) for transporting the exhaust gas and cooling water to the boat hull exterior.

As with the preferred embodiment the muffler housing 210 silences the exhaust gas, from the internal combustion marine engine by directing high velocity exhaust gas and cooling water injected and mixed therewith, through inlet passageway 230 into lower silencing volume 224. The energy of the escaping exhaust gas will force the remaining differential volume of cooling water and gas upwards and into silencing volume 220 where the gas and water may escape through outlet passageway 232. The angularly disposed planar baffle 214 functions as an acoustical barrier by creating sonic reflections with the housing wall 210 which assist in dissipating the acoustical energy of the exhaust, and as a surge protector by countering any reverse flow of water into the muffler by creating a trap area within upper silencing volume 220. The instant design having the inlet 230 along the lower wall 204 and the outlet 232 a predetermined distance between the top wall 202 and the bottom wall 204 provides an inlet and outlet at different heights to accommodate exhaust pipe elevation changes without the need of additional piping. Accordingly, less external exhaust piping is required as in the preferred embodiment while further providing a workable upper silencing volume in combination with a double break for handling water surges.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A muffler for a marine engine, comprising:

a housing means comprised of a side wall, a top closure panel and a bottom closure panel sealingly connected to said side wall to define an interior chamber therein;

an impervious means for baffling defining a centrally disposed aperture therethrough, said means for baffling having an outer peripheral edge sealingly attached to said side wall such that said housing interior chamber is partitioned into an upper and a lower silencing volume;

means for conveying exhaust gas from said lower silencing volume to said upper silencing volume fluidly communicating said lower silencing volume with said upper silencing volume, said means for conveying being sealingly connected to said means for baffling;

means for receiving a flow of exhaust gas fluidly communicating said lower silencing volume with a source of exhaust gas flow;

means for exhausting an exhaust gas flow of reduced energy to the ambient fluidly communicating said upper silencing volume with the ambient;

said means for baffling being disposed at ar angle with respect to the horizontal so as to expel by the force of gravity fluid entering said upper silencing volume through said means for exhausting.

2. The muffler recited in claim 1, wherein said housing side wall defines a circular section when viewed normal to said top and bottom closure panels.

3. The muffler recited in claim 1, wherein said housing side wall defines an elliptical section when viewed normal to said top and bottom closure panels.

4. The muffler recited in claim 1, wherein said housing defines a rectangular section when viewed normal to said top and bottom closure panels.

5. The muffler recited in claim 1, wherein said means for conveying is an elongated cylinder having open top and bottom ends.

6. The muffler recited in claim 1, wherein said means for receiving is disposed collinearly with said means for exhausting.

7. The muffler recited in claim 1, wherein said means for receiving is disposed non-collinearly with said means for exhausting.

8. The muffler according to claim 1, wherein said means for baffling is attached to said housing at an angle between 5 and 90 degrees.

9. The muffler recited in claim 1, wherein said housing means is fabricated from fiberglass.

10. The muffler recited in claim 1, wherein said housing is fabricated from corrosion resistent metal.

11. A muffler for a marine engine, comprising:

a housing means having a side wall which terminates in a top and a bottom end to define a sealed interior chamber therein;

an impervious means for baffling defining a centrally disposed aperture therethrough, said means for baffling terminating in an outer periphery connected to said side wall of said housing and sealably attached at an angle thereto such that said housing interior chamber is partitioned into an upper and lower silencing volume;

an elongated conduit means having a bore therethrough, disposed through said baffle aperture and sealably attached to said baffle, said elongated conduit means having a length less than the distance between said housing top and bottom end;

inlet means associated with said housing side wall for permitting the influx of said exhaust gas and cooling water through said housing side wall and into said lower silencing volume, said inlet means comprising a hollow tubular section integral with said housing side wall; and outlet means associated with said housing side wall for permitting the efflux of said exhaust gas and cooling water from said upper silencing volume through said housing side wall, said outlet means comprising a hollow tubular section integral with said housing side wall and disposed collinearly with said inlet tubular section, whereby said exhaust gas and cooling water enters said lower silencing volume wherein said gas and water is provided an area for reduced velocity to attenuate exhaust noise before forced said elongated cylindrical member and into said upper silencing volume wherein said gas and water may exit through said hollow tubular outlet means, said angularly disposed planar baffle defining a trap area within said silencing volume for preventing the reversed flow of water into said engine.

* * * * *